US009468351B2

(12) United States Patent
Meissner et al.

(10) Patent No.: US 9,468,351 B2
(45) Date of Patent: Oct. 18, 2016

(54) CARPET CLEANING SYSTEM

(71) Applicants: Timothy A. Meissner, Power Springs, GA (US); Steven A. Meissner, Power Springs, GA (US); Jay P. Meissner, Power Springs, GA (US); Steven Allen Meissner, Power Springs, GA (US)

(72) Inventors: Timothy A. Meissner, Power Springs, GA (US); Steven A. Meissner, Power Springs, GA (US); Jay P. Meissner, Power Springs, GA (US); Steven Allen Meissner, Power Springs, GA (US)

( * ) Notice: Subject to any disclaimer, the term of this patent is extended or adjusted under 35 U.S.C. 154(b) by 0 days.

(21) Appl. No.: 13/987,459

(22) Filed: Jul. 26, 2013

(65) Prior Publication Data

US 2015/0026914 A1 Jan. 29, 2015

(51) Int. Cl.
*A47L 11/34* (2006.01)
*A47L 11/40* (2006.01)

(52) U.S. Cl.
CPC ..... *A47L 11/34* (2013.01); *A47L 11/4044* (2013.01)

(58) Field of Classification Search
USPC ..... 15/320–323, 410; 134/21; 239/305, 310
See application file for complete search history.

(56) References Cited

U.S. PATENT DOCUMENTS

| | | | | | |
|---|---|---|---|---|---|
| 4,218,900 | A * | 8/1980 | Caplan et al. | ..... | 68/205 R |
| 4,333,203 | A * | 6/1982 | Yonkers | ..... | 15/321 |
| 5,113,547 | A * | 5/1992 | Mayhew | ..... | 15/322 |
| 5,180,439 | A * | 1/1993 | Allison | ..... | 134/21 |
| 5,555,599 | A * | 9/1996 | Markley | ..... | 15/322 |
| 5,697,119 | A * | 12/1997 | Mussalo | ..... | 15/320 |
| 6,263,539 | B1 * | 7/2001 | Baig | ..... | 15/322 |

* cited by examiner

*Primary Examiner* — Dung Van Nguyen

(57) ABSTRACT

A carpet cleaning system having a single, hand-held wand and mounted on it, a pre-spray canister, a venturi tee fluidly connected thereto, and valves for directing pressurized hot water into first and/or second flow streams. Downstream of a flow-splitting tee, a single valve regulates the first flow stream; and a pair of valves, sandwiching the venturi tee, regulate the second flow stream. This pair also controls cleaning solution discharging from the pre-spray canister via the venturi tee. Positioned at the operator's fingertips are the single valve's handle and a bar for moving the paired valves' handles simultaneously, thus allowing one to momentarily turn on or off either flow stream or adjust a mix thereof. Importantly, without interrupting any steam cleaning then in progress, one can immediately reapply the cleaning solution to a stain and, as a consequence, substantially upgrade the quality of the finished carpet cleaning job.

6 Claims, 7 Drawing Sheets

CARPET CLEANING SYSTEM

CROSS REFERENCE TO RELATED APPLICATION

This application is a non-provisional application of the earlier filed provisional application, Ser. No. 61/741,721, filed Jul. 26, 2012, and claims the benefit of the priority of the filing date of Jul. 26, 2012, pursuant to 35 U.S.C. Sec. 119(e).

BACKGROUND OF THE INVENTION

The standard procedure for cleaning a carpet with a commercial cleaning apparatus is first to unroll a pair of hoses: a vacuum hose and a high pressure liquid hose. Both of these hoses, transported earlier to the job site, are generally rolled on reels mounted inside of a van. As they are being unrolled, the hoses are carried through the door of the apartment or house to its most distant part. Sometimes this distance exceeds 300 feet.

The technician then goes back to the van to gather a pre-spray attachment, a standard wand and a rake and takes these tools into the residence. Working backwards towards the entrance, the technician, using the pre-spray attachment, applies a stain-removing chemical fluid to the carpet. Not until he has disconnected the pre-spray attachment from the wand and re-positioned both of the hoses so that they once again reach the most distant part of the dwelling, does he finally connect the high pressure hose, which itself is connected to a hot water supply in the van, and the suction hose to the wand. Only then is he ready to steam clean the carpet.

During the course of steam cleaning, a second application of the stain-removing chemical fluid is often required. The technician then disconnects the high pressure hose and reconnects the pre-spray attachment so that he can re-spray the stubborn stain. Frequently, the pre-spray attachment is left in another room of the residence so time must be spent to retrieve it.

Once cleaning is complete, the wand, the pre-spray attachment, and the hoses are taken back to the van; and the truck mounted engine is turned off.

The final step in the standard cleaning procedure is to use the rake to give the carpet a fluffed and patterned look.

SUMMARY OF THE INVENTION

The object of this invention is to provide an improved carpet cleaning system in order to reduce the strain on the technician doing a carpet cleaning job as well as the time required to do it.

A further object is to provide such a system which one can use to reapply the stain-removing chemical fluid immediately, as needed, during the course of a steam cleaning operation but without interrupting it, so that optimal results can be achieved.

In accordance with the present invention, there is provided a system having an improved wand on which are mounted a pre-spray canister, a venturi tee fluidly connected thereto, and means, including a first valve and paired second and third valves, for directing the pressurized hot water flow into first and/or second flow streams, respectively. In addition, a manually-operated control mechanism which, in use, simultaneously opens, partly opens, or closes the second and third valves is mounted near the wand's handle and within reach of the wand operator's fingertips.

Preferably, the venturi tee is located just below the upstream member of the two paired valves, so that when the second flow stream, if present, encounters the venturi tee, some of the fluid in the canister is sucked out of it and mixes with hot water in this second stream as it is passing through the paired valves' downstream member enroute to the wand's spray nozzles. Thus with the improved wand, the technician needs only to use his fingertips while steam cleaning a carpet to immediately reapply stain-removing chemical fluid, mixed with hot water, to it.

Alternately, the technician has the option of using hot water alone, by simply opening the first valve while keeping the paired second and third valves closed, to pre-spray for spot removal.

Not only is a pre-sprayer always at the fingertips of the technician, but also the finishing rake is attached to the improved wand. The latter combination allows the technician to fluff the carpet while steam cleaning it, thereby improving the quality of the finished job. Moreover, having these tools mounted on the wand saves enough time on the job to increase the technician's output by at least two additional jobs per day.

DETAILED DESCRIPTION OF THE PREFERRED EMBODIMENT

Figure 1:
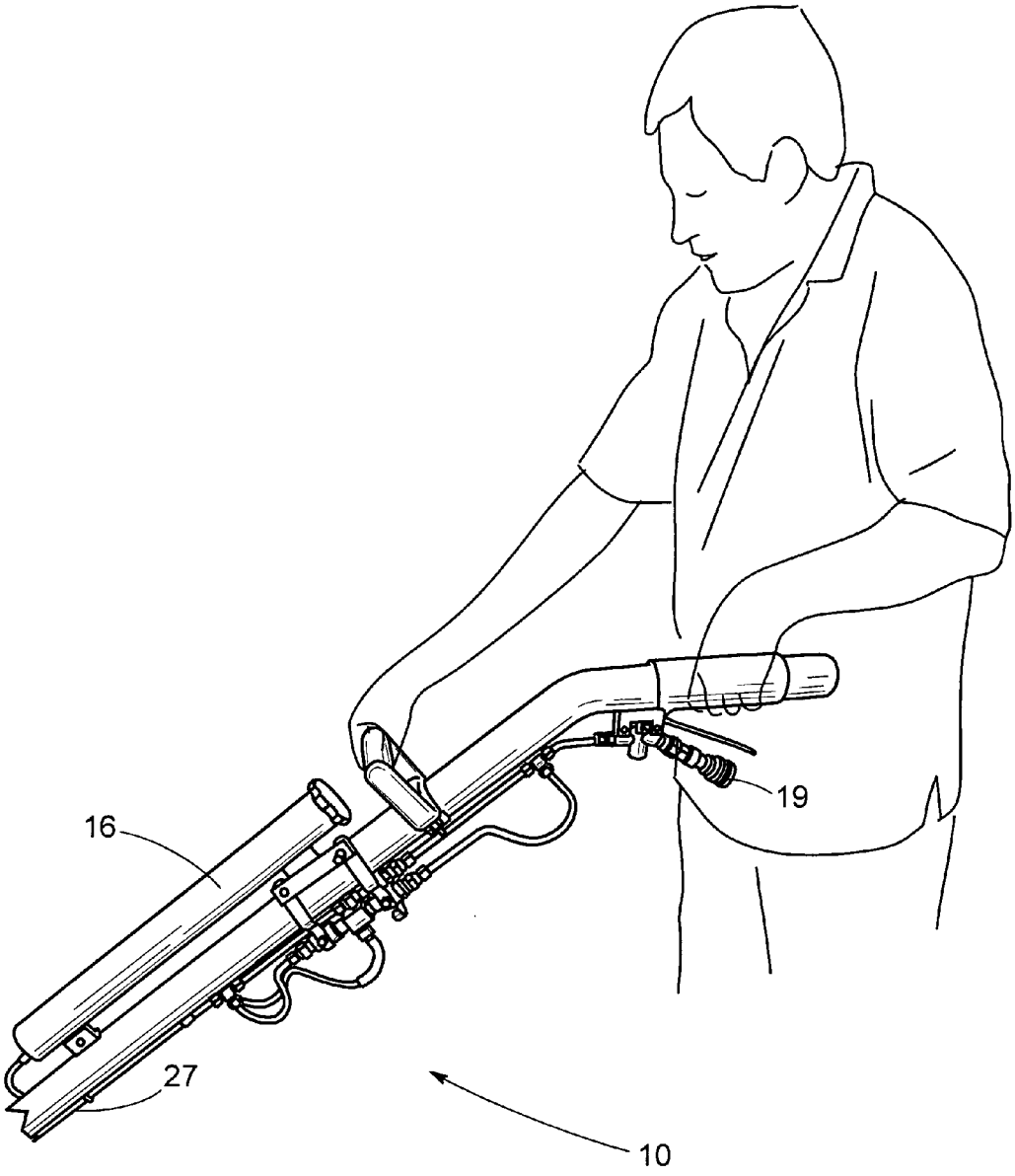
FIG. 1 is a left side perspective view of a fragmentary portion of the wand according to the present invention, showing a technician holding the wand.
Figure 2:
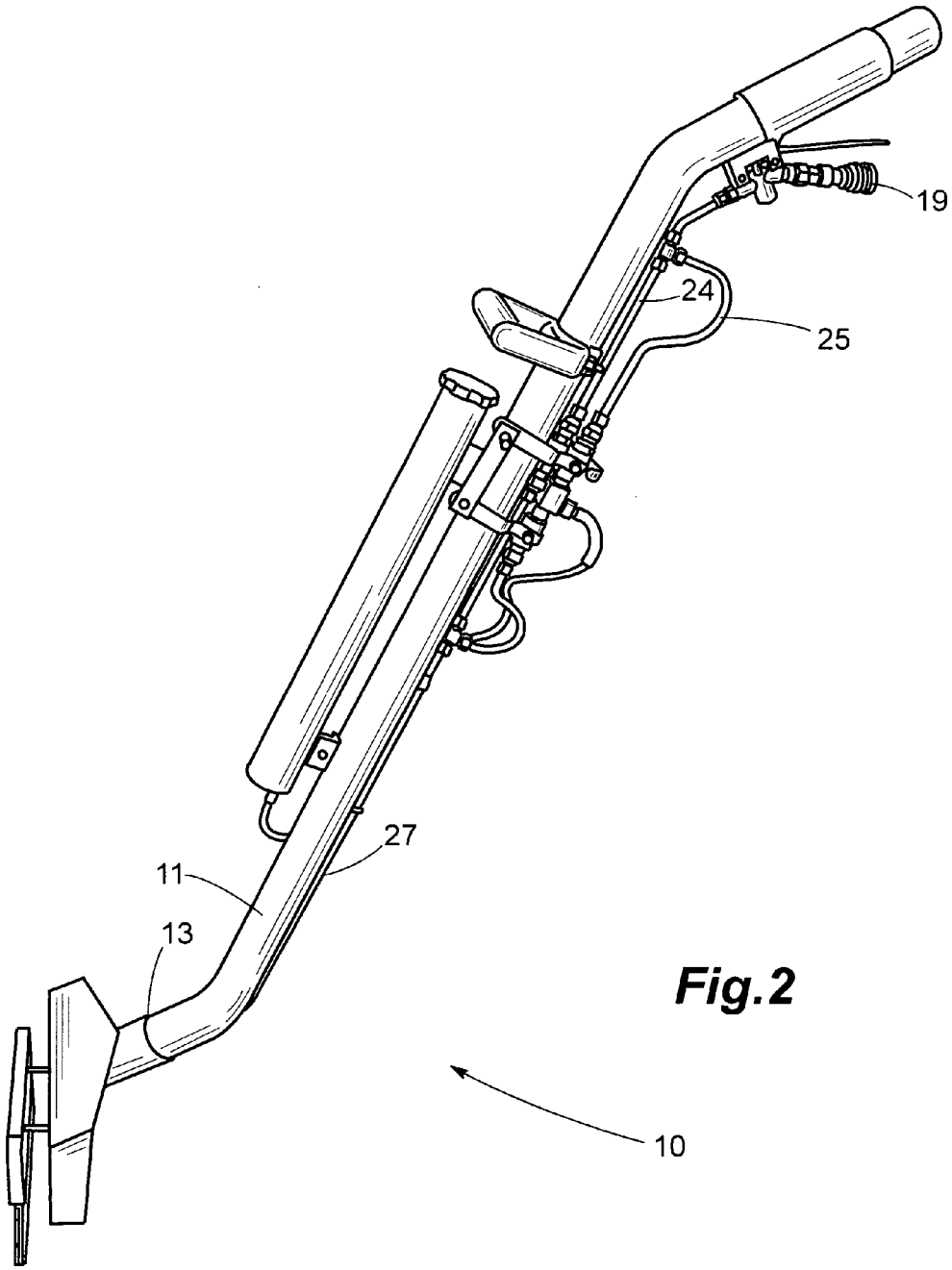
FIG. 2 is a left side perspective view, on an enlarged scale, of the wand according to the present invention.
Figure 3:
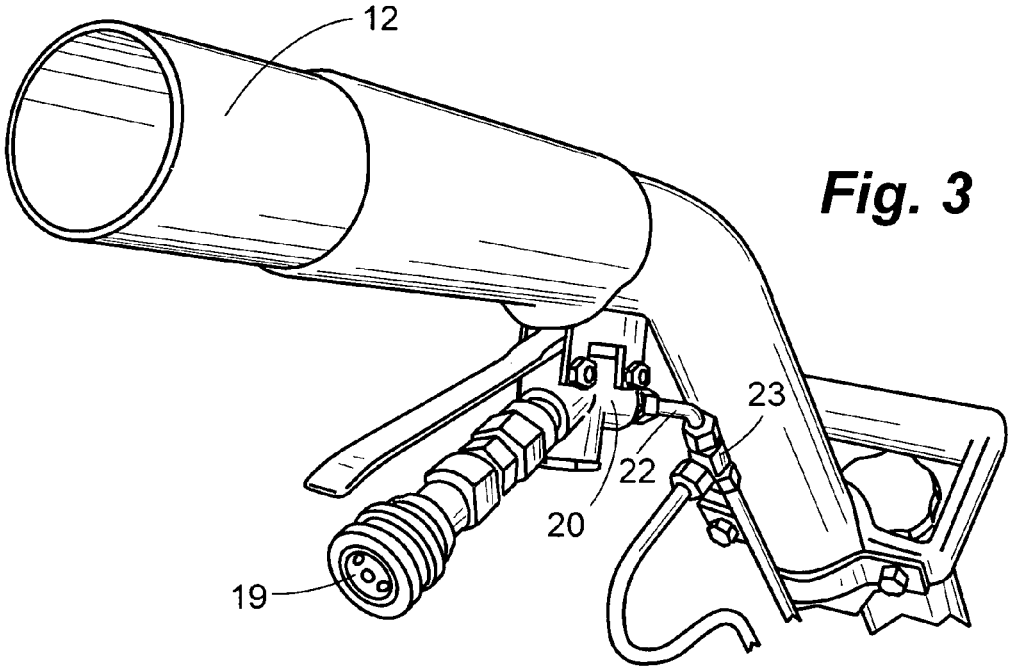
FIG. 3 is a top end, right side perspective view, on a further enlarged scale, of the wand according to FIG. 2, showing the wand's pressurized hot water inlet fitting and a control valve and flow-splitting tee, both of which are fluidly connected thereto, as well as the wand's vacuum hose connection, with only a fragmentary portion of the wand being illustrated.
Figure 8:
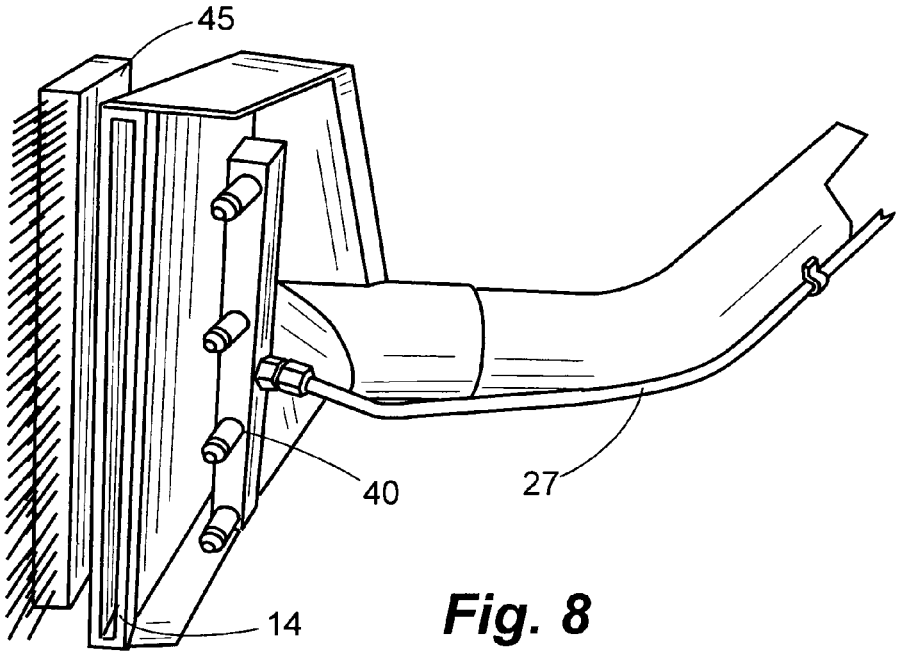
FIG. 8 is a perspective view, on a further enlarged scale, of a fragmentary portion of the wand according to FIG. 2, show- the underside of the wand's working end including spray nozzles and a finishing rake.

In the drawings, the wand according to the present invention is indicated generally by the reference numeral 10. The frame 11 of the wand 10 is a hollow tube which, in shape, resembles a stretched "S" (FIG. 2). At the top end of the frame 11 is a fitting for a suction hose 12 (FIG. 3). The distal end 13 of the frame 11 is fitted with a suction intake structure 14, spray nozzles 40, and a rake 45 (FIG. 8).

Figure 7:
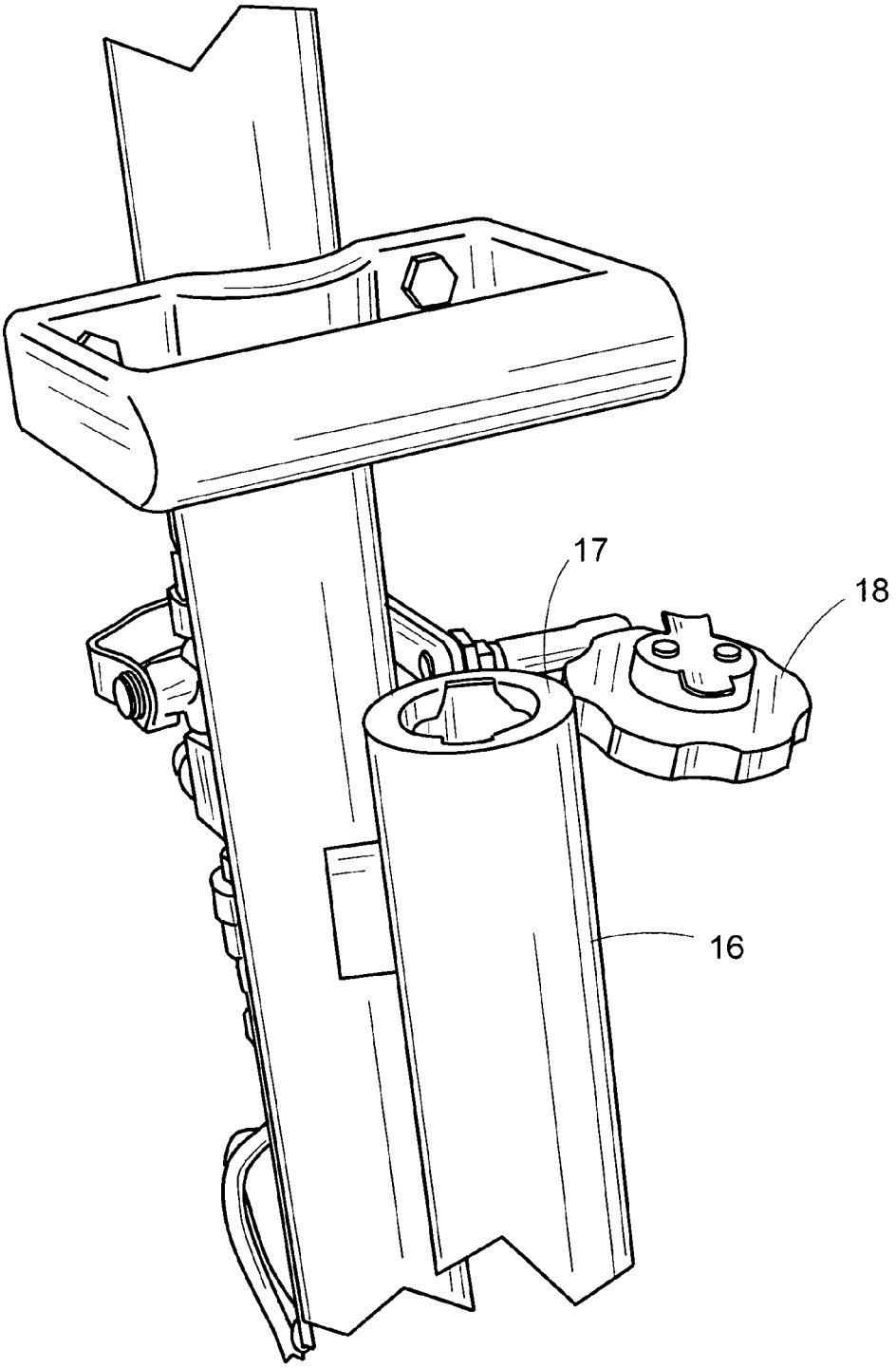
FIG. 7 is a perspective view, on a yet further enlarged scale, of a fragmentary portion of the wand according to FIG. 2, showing the upper end of a pre-spray canister mounted on the wand, with the canister's top cap temporarily removed.
Figure 9:
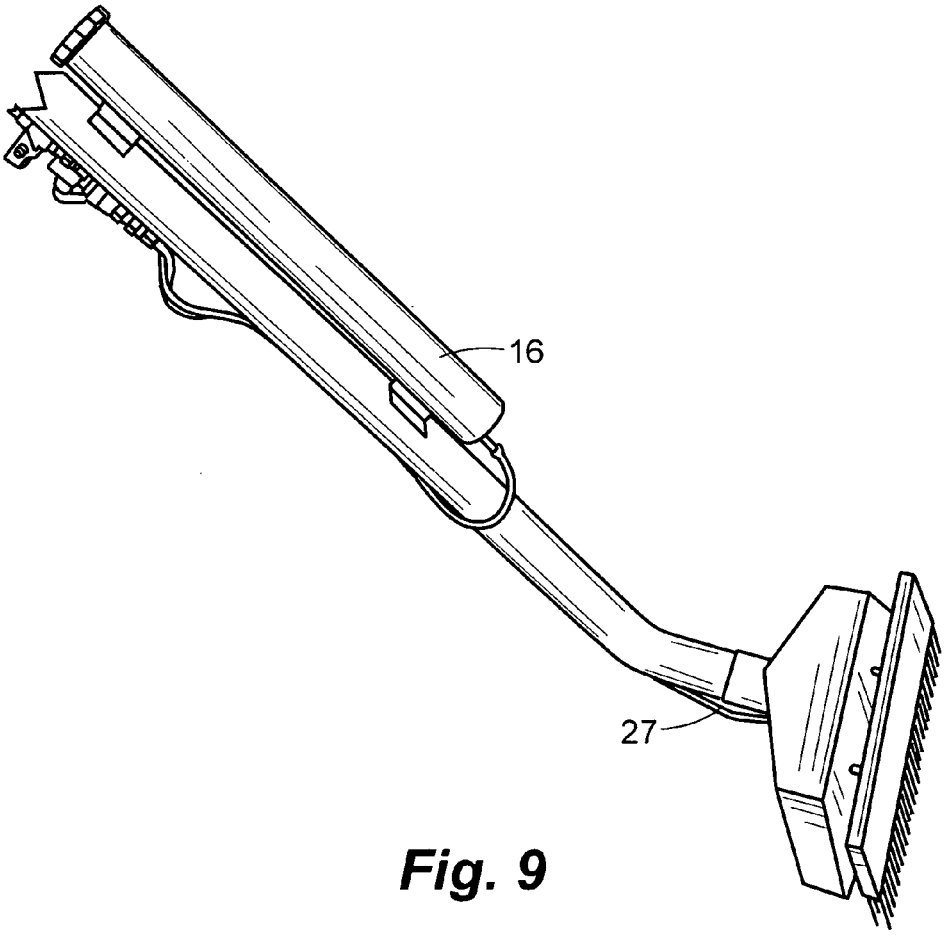
FIG. 9 is a perspective view of the right side of a fragmentary portion of the wand according to FIG. 2, showing the wand's working end in cleaning position and the pre-spray canister.

Mounted on the frame 11 is a pre-spray canister in the form of an elongated tank 16 which, during use, is sealed, at its upper end 17, by a removable cap 18. Prior to use, the cap 18 is removed; and a cleaning solution such as a stain-removing chemical fluid is poured into the tank 16 through an opening defined by the upper end 17. The cap 18 is then replaced, sealing the tank and its contents (FIGS. 2, 7 and 9).

Figure 4:
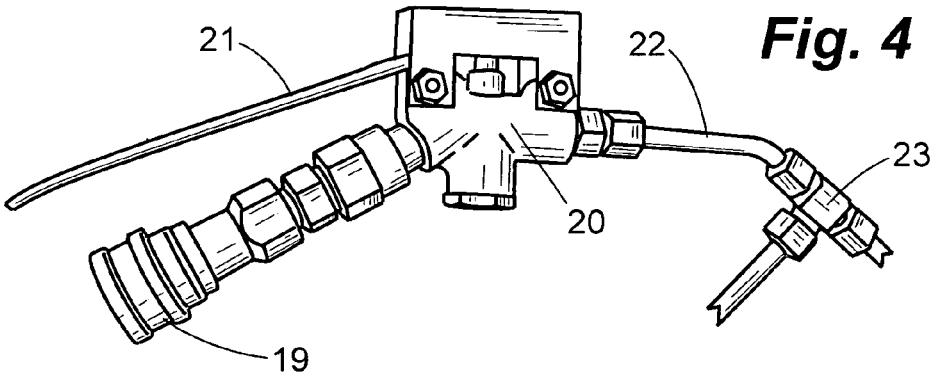
FIG. 4 is a right side perspective view, on a still further enlarged scale, of the hot water inlet fitting and of the control valve and flow-splitting tee according to FIG. 3, with only fragmentary portions of downstream tubes connected to the tee shown.
Figure 5:
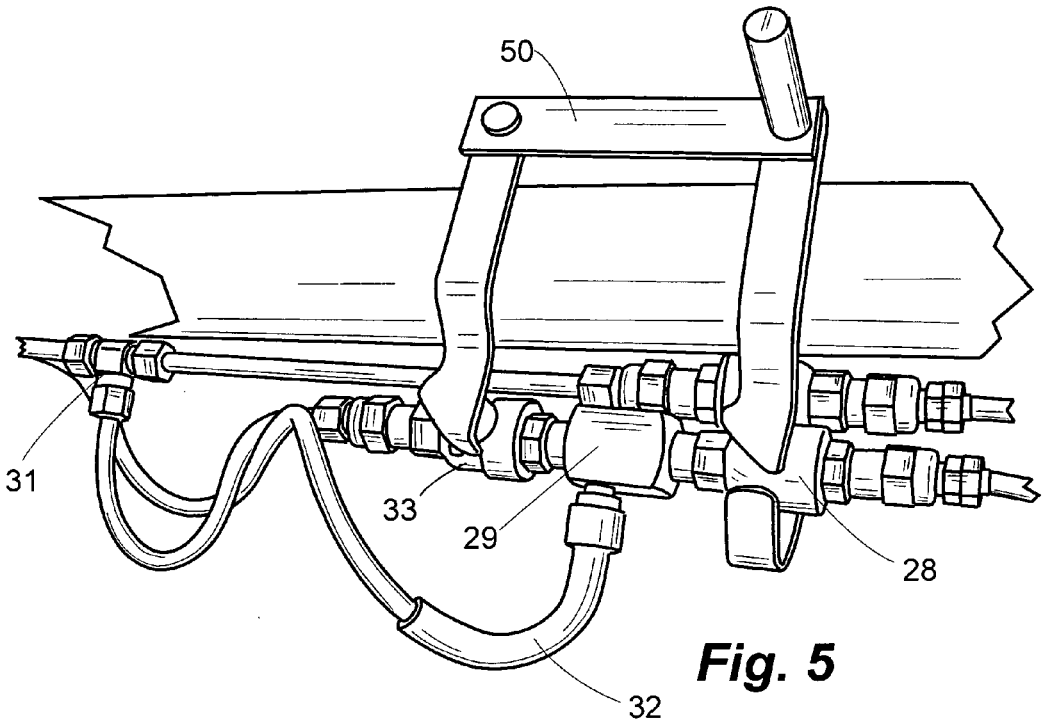
FIG. 5 is a left side perspective view, on a yet further enlarged scale, of a fragmentary portion of the wand according to FIG. 2, showing a first valve and paired second and third valves for regulating first and/or second flow streams, respectively, enroute to the wand's spray nozzles, as well as showing a manual control mechanism for simultaneously opening, partly opening, or closing the second and third valves and a venturi tee for sucking stain-removing chemical fluid into the second stream when it is present.
Figure 6:
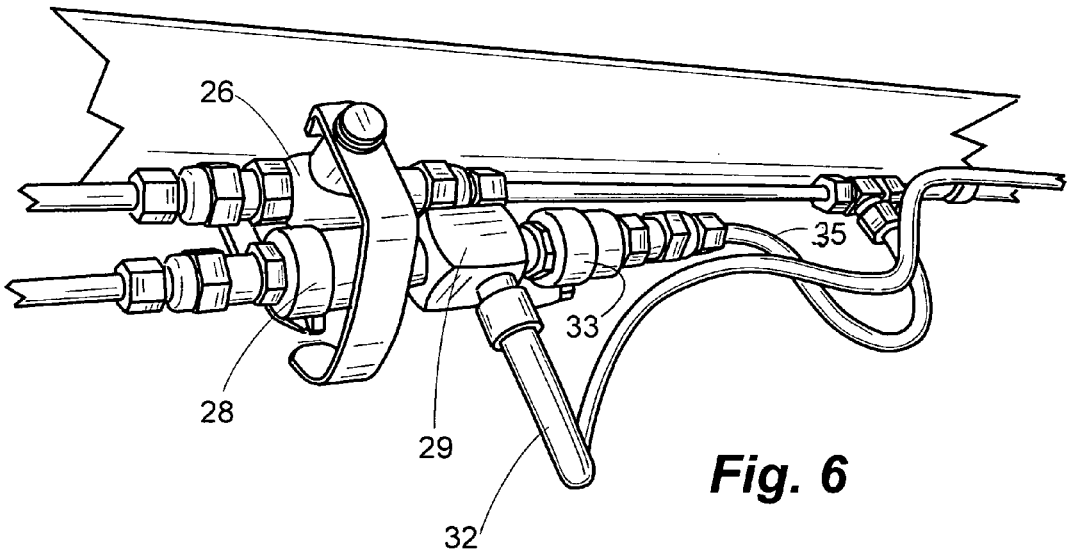
FIG. 6 is a perspective view, on a yet further enlarged scale, of the underside of a fragmentary portion of the wand, showing a tee fluidly connected to, and located downstream of, both the first valve and the paired second and third valves according to FIG. 5.
Figure 10:
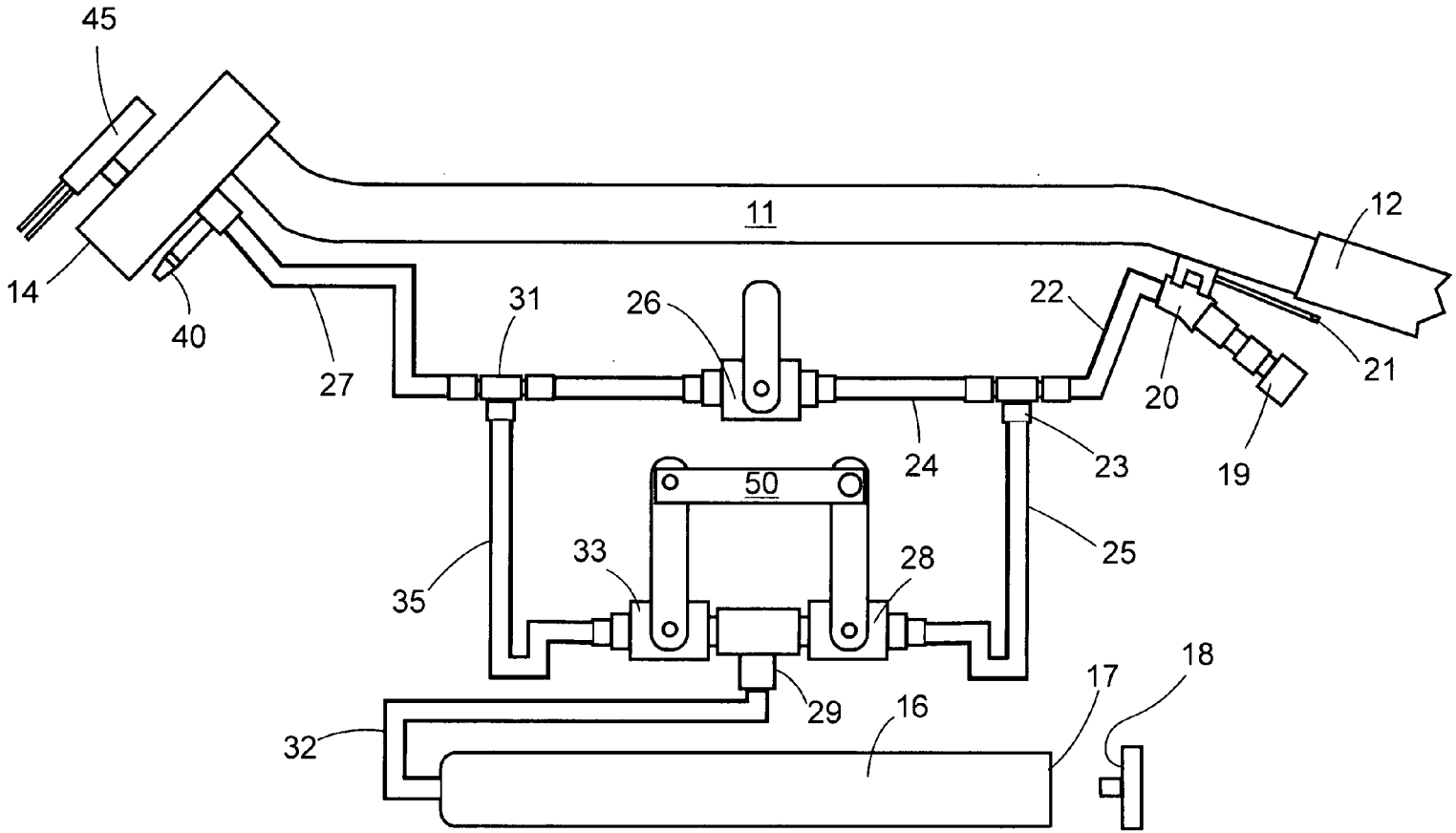
FIG. 10 is a schematic diagram of the fluid control systems for the wand according to FIG. 2.

Supported by the frame 11 is a pressure hose fitting 19 through which hot water, typically heated to about 240 degrees F., is supplied to the wand 10. Once valve 20 has been opened by moving its handle 21 upwardly, hot water can enter into tube 22 (FIGS. 3, 4 and 10). There the hot water flow encounters tee 23 which splits it into first and second flow streams directed into tubes 24 and 25, respectively (FIGS. 4 and 10). When ball valve 26 is opened, hot water in the first flow stream is allowed to pass downstream through tee 31 and tube 27 and then discharge through spray nozzles 40 (FIGS. 5, 6, 8 and 10).

Discharge of cleaning solution from the tank 16 is controlled by a pair of valves 28 and 33. A manually-operated control mechanism in the form of a bar 50 connects the handles of ball valves 28, 33 in such a way that both of them are open, partly open, or closed at the same time. When ball valve 26 is closed, shutting off the first flow stream, all of the hot water flow can then be directed through open valves 28 and 33 and venturi tee 29. There a structure (not shown) which is housed within the straight portion of venturi tee 29 creates, as the second flow stream speeds past it, a suction venturi which causes cleaning solution to be sucked from the tank 16 through tube 32 and into valve 33. Below valve 33, a mixture of cleaning solution and hot water flows into tube 35 and tee 31 before entering tube 27 and ultimately being discharged through spray nozzles 40 (FIGS. 5, 6, 8 and 10).

By setting both the control mechanism's bar 50 and the handle of valve 26 in their respective intermediate positions so that each of the valves 26, 28 and 33 is partly open, the technician can adjust the ratio of hot water to cleaning fluid in the mixture discharged through the spray nozzles 40.

Also mounted on the wand 10 near the suction inlet structure is a rake 45 which can be employed to give the cleaned carpet a fluffed up, patterned finish. This final finishing step is done as the technician works his way toward the entrance. As illustrated in FIGS. 2, 8 and 9, the rake 14 is fixed in position with respect to the suction intake structure 14; alternately, a movable rake (not shown) can be employed.

It is claimed:

1. In a carpet cleaning system which includes a handheld wand and a pressurized hot water sprayer, the wand defining an elongated hollow tube, distal ends thereof being fluidly connected to a vacuum source and to a suction inlet structure, respectively, the suction inlet structure defining a through channel and a generally flat face with an elongated slot formed therein, the generally flat face, during use, being slideable across a carpet in such a way that the elongated slot is disposed in close proximity thereto, the through channel fluidly connecting the elongated slot to the hollow tube, the hot water sprayer including a water inlet fitting and a plurality of spray nozzles, fluidly connected thereto and disposed proximate with the elongated slot, for discharging pressurized hot water, as it flashes to steam, onto the carpet, so that the vacuum source can be utilized to suck dirt off of the carpet as it is being steamed and immediately transport the dirt, via an elongated hose, to a holding tank for disposal, wherein the improvement comprises:

(a) a canister for holding stain-removing cleaning fluid, the canister being positioned on the wand proximate with the hollow tube's mid-section;

(b) means, including a flow-splitting tee and first, second and third valves, for directing pressurized hot water into first and/or second flow streams, the first valve and the second and third valves, as a pair, regulating the first and second flow streams, respectively, downstream of the flow-splitting tee; and (c) a venturi tee fluidly connected to the canister, the venturi tee defining a straight section, disposed upstream of the third valve and juxtaposed between it and the second valve, through which the second flow stream passes when the second and third valves are open and pressurized hot water is flowing through the system, the venturi tee's straight section, as the second flow stream passes therethrough, creating a suction venturi which causes cleaning fluid to be sucked from the canister and mixed with hot water in the second flow stream as it passes through the third valve enroute to being further mixed, when the first valve is also open, with hot water in the first flow stream and then discharged as a cleaning fluid/hot water mixture through the spray nozzles.

2. In the carpet cleaning system according to claim 1, wherein the improvement further comprises means, including a manually-operated control mechanism mounted on the wand proximate with its handle and within reach of the operator's fingertips, for momentarily turning on or turning off each of the first and second flow streams on an individual basis, so that without interrupting any steam cleaning then in progress, one can immediately reapply the cleaning fluid to a stain.

3. In the carpet cleaning system according to claim 2, wherein the manually-operated control mechanism includes a bar connected to the second and third valves' respective handles in such a way that both the second and third valves are open, partly open, or closed at the same time.

4. In the carpet cleaning system according to claim 1, wherein the improvement further comprises means, including a control mechanism mounted on the wand and within reach of the operator's fingertips, for momentarily increasing or reducing each of the first and second flow streams on an individual basis, so that one can readjust the ratio between the first and second flow streams in a mixture thereof as it is being discharged from the spray nozzles and conserve cleaning fluid in the process.

5. In the carpet cleaning system according to claim 1, wherein the improvement further comprises means, including a rake mounted proximate with the suction inlet structure, for fluffing up the carpet and giving it a patterned finish.

6. In the carpet cleaning system according to claim 1, wherein the canister is further characterized as being elongated and generally cylindrical in shape, the canister, so positioned on the wand proximate with the hollow tube's mid-section, extending longitudinally generally parallel with the mid-section's longitudinal centerline.

* * * * *